US012295532B2

(12) United States Patent
Xie

(10) Patent No.: US 12,295,532 B2
(45) Date of Patent: May 13, 2025

(54) LIFTING DEVICE FOR CLEANING ASSEMBLY AND CLEANING APPARATUS

(71) Applicants: Yunjing Intelligence Innovation (Shenzhen) Co., Ltd., Guangdong (CN); Yunjing Intelligence (Shenzhen) Co., Ltd., Guangdong (CN)

(72) Inventor: Minzhao Xie, Shenzhen (CN)

(73) Assignees: Yunjing Intelligence Innovation (Shenzhen) Co., Ltd., Shenzhen (CN); Yunjing Intelligence (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 18/620,761

(22) Filed: Mar. 28, 2024

(65) Prior Publication Data

US 2024/0237869 A1 Jul. 18, 2024

Related U.S. Application Data

(63) Continuation of application No. PCT/CN2022/111661, filed on Aug. 11, 2022.

(30) Foreign Application Priority Data

Sep. 29, 2021 (CN) ..... 202122384246.1

(51) Int. Cl.

| | |
|---|---|
| ***A47L 11/40*** | (2006.01) |
| ***A47L 5/34*** | (2006.01) |
| ***A47L 9/04*** | (2006.01) |
| ***A47L 11/19*** | (2006.01) |

(52) U.S. Cl.
CPC ..... *A47L 11/4058* (2013.01); *A47L 5/34* (2013.01); *A47L 9/0494* (2013.01); *A47L 11/19* (2013.01); *A47L 11/4055* (2013.01); *A47L 11/4005* (2013.01)

(58) Field of Classification Search
CPC ..... A47L 11/4058; A47L 5/34; A47L 9/0494; A47L 11/19; A47L 11/4055; A47L 11/4005
See application file for complete search history.

(56) References Cited

U.S. PATENT DOCUMENTS

| | | | | |
|---|---|---|---|---|
| 2022/0248928 | A1* | 8/2022 | Xie | A47L 9/0494 |
| 2024/0148212 | A1* | 5/2024 | Sun | A47L 11/282 |

FOREIGN PATENT DOCUMENTS

| | | | |
|---|---|---|---|
| CN | 108852227 | B | 4/2020 |
| CN | 210330144 | U | 4/2020 |
| CN | 112847432 | A | 5/2021 |
| DE | 102018222657 | A1 | 6/2020 |

* cited by examiner

*Primary Examiner* — David Redding
(74) *Attorney, Agent, or Firm* — Leydig, Voit & Mayer, Ltd.

(57) ABSTRACT

The present disclosure provides a lifting device for cleaning assembly and a cleaning apparatus. The lifting device includes a guiding base and a lifting assembly. The guiding base is arranged on an external housing. The lifting assembly includes a lifting mechanism connected with the cleaning assembly and slidably coupled to the guiding base, and a driving member arranged on the guiding base and configured to drive the lifting mechanism to move with respect to the guiding base.

20 Claims, 7 Drawing Sheets

LIFTING DEVICE FOR CLEANING ASSEMBLY AND CLEANING APPARATUS

CROSS-REFERENCE TO RELATED APPLICATIONS

This application is a continuation of International Application No. PCT/CN2022/111661, filed on Au. 11, 2022, which claims priority to Chinese Patent Application No. 202122384246.1, filed on Sep. 29, 2021. The disclosures of both of the aforementioned applications are hereby incorporated by reference in their entireties.

TECHNICAL FIELD

The present disclosure relates to the field of cleaning apparatus and, in particular, to a lifting device for a cleaning assembly and a cleaning apparatus.

BACKGROUND

Roller brush assemblies have been widely used in cleaning apparatus, such as cleaning robots. A conventional roller brush assembly is fixed to a bottom housing of a cleaning robot. Thus, the roller brush assembly cannot be lifted up or down to adjust its position. As such, it is prone to cause a secondary pollution to the region which has been cleaned during a round trip of the cleaning apparatus, because the roller brush assembly cannot be lifted up to keep off the region. Other cleaning assemblies or apparatus may also have similar problems as that of the conventional roller brush assemblies.

SUMMARY

The present disclosure provides a lifting device for cleaning assembly which can lift the cleaning assembly and simultaneously has the advantage of simple structure.

The present disclosure further provides a cleaning apparatus which includes the lifting device for cleaning assembly.

In some embodiments, the present disclosure provides a lifting device for cleaning assembly comprising a guiding base and a lifting assembly. The guiding base is arranged on an external housing. The lifting assembly comprises a lifting mechanism connected with an external cleaning assembly and slided up or down on the guiding base, and a driving member arranged on the guiding base and in drive connection with the lifting mechanism. The driving member drives the lifting mechanism to lift up or down relative to the guiding base, allowing the cleaning assembly to lift up or down relative to the housing.

In some embodiments, the lifting mechanism comprises a guiding block and a lifting block. The guiding block is slidably connected to the guiding base and in drive connection with the driving member, and a side of the lifting block away from the guiding block is connected with the cleaning assembly. One of the lifting block and the guiding block is provided with a groove, and the other is slidably arranged in the groove. The driving member drives the guiding block to slide along a first direction, allowing the lifting block to move up or down in the groove along a second direction, and the first direction and the second direction are not parallel.

In some embodiments, the groove is obliquely arranged on the guiding base.

In some embodiments, a sliding seat is provided on a side of the lifting block facing the guiding block, and the sliding seat is slidably arranged in the groove.

In some embodiments, one end of the groove in the length direction of the groove is connected with an upper transverse sliding groove, the other end of the groove in the length direction is connected with a lower transverse sliding groove, and the upper transverse sliding groove and the lower transverse sliding groove each has a length direction parallel to the first direction.

In some embodiments, the lifting device further comprises a transmission mechanism comprising a screw rod, one end of the screw rod is connected to the driving member, the other end of the screw rod is threadedly connected to the guiding block, and a length direction of the screw rod is parallel to the first direction.

In some embodiments, the transmission mechanism further comprises a fixing member fixedly connected with the guiding block and threadedly connected with an end of the screw rod away from the driving member.

In some embodiments, the lifting device further comprises a transmission mechanism. The transmission mechanism comprises a rack arranged on the guiding base with a length direction of the rack being parallel to the first direction, and a gear meshed with the rack. The driving member is connected to the gear to drive the gear to rotate.

In some embodiments, the rack and the guiding base are integrally formed.

In some embodiments, the guiding base is defined with a through guiding hole along the second direction, the lifting block is slidably arranged in the guiding hole, and the guiding block is located above the guiding hole.

In some embodiments, the cleaning assembly comprises a lap portion, the lifting mechanism comprises a lifting block lifted up or down relative to the guiding base, the lifting block is defined with a floating hole, and the lap portion is disposed in the floating hole. A diameter of the floating hole along a lifting direction of the lifting block is larger than the length of the lap portion, and the lap portion moves upward along the floating hole upon the cleaning assembly being pushed by an obstacle.

In order to achieve the another object, the present disclosure further provides a cleaning apparatus. The cleaning apparatus comprises a main body, the lifting device for cleaning assembly as described above, and a cleaning assembly. The main body comprises a housing, and the guiding base is arranged on the housing.

In some embodiments, the cleaning assembly comprises a roller brush housing movably connected with the lifting mechanism, a roller brush arranged on the roller brush housing, and a roller brush driving mechanism arranged on the roller brush housing to drive the roller brush to rotate.

In some embodiments, the roller brush housing comprises a lap portion, the lifting mechanism comprises a lifting block which lifts up or down relative to the guiding base, the lifting block is defined with a floating hole, and the lap portion is disposed in the floating hole. A diameter of the floating hole along a lifting direction of the lifting block is larger than the length of the lap portion, and the lap portion moves upward along the floating hole upon the cleaning assembly being pushed by an obstacle.

In the present disclosure, the lifting mechanism of the lifting device can slide up or down on the guiding base by the driving of the driving member, the cleaning assembly is connected with the lifting mechanism, when the lifting mechanism is lifted up or down relative to the guiding base, the cleaning assembly can be driven to lift up or down relative to the housing, such that the cleaning assembly can leave the ground to prevent performing a cleaning to the region where cleaning is not needed. Also, the lifting device for cleaning assembly of the present disclosure has the advantage of simple structure.

DETAILED DESCRIPTION

Figure 1:
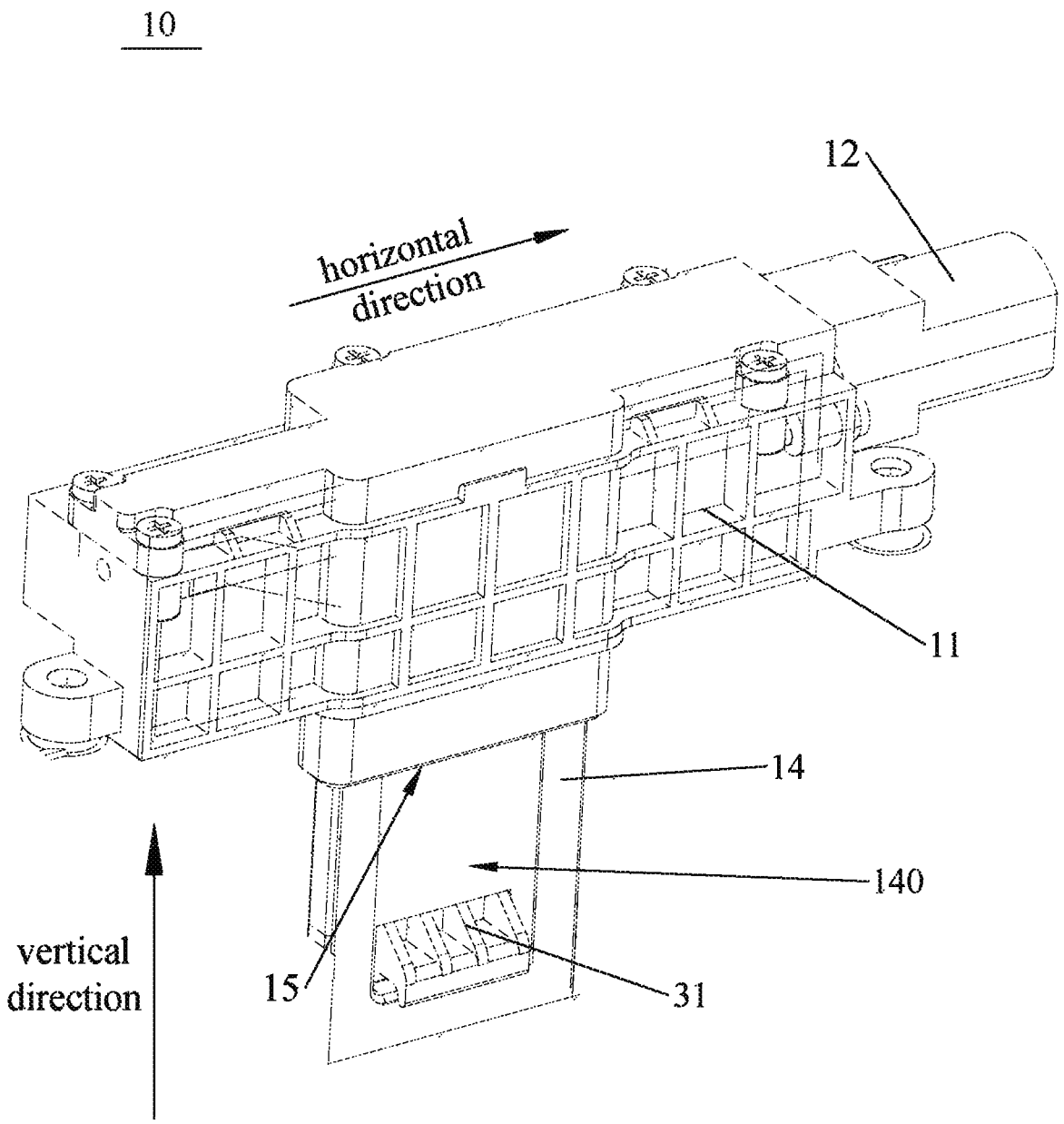
FIG. 1 illustrates a view of a lifting device for a cleaning assembly, according to an exemplary embodiment of the present disclosure.

FIGS. 1-7 illustrate several views of a lifting device 10 for a cleaning apparatus 1, according to some embodiments of the present disclosure. The lifting device 10 includes a guiding base 11 and a lifting assembly 16. The guiding base 11 may be fixed to an external structure, such as a housing 21 of the cleaning apparatus 1. The lifting assembly 16 may include a lifting mechanism 17 and a driving member 12. The lifting mechanism 17 is slidably coupled to the guiding base 11. The lifting mechanism 17 may be also configured to engage with an external cleaning assembly 30 through a lap portion 31 as further shown in FIG. 7. The driving member 12 is arranged or disposed on the guiding base 11 and coupled with the lifting mechanism 17. The driving member 12 drives the lifting mechanism 17 to slide with respect to the guiding base 11, allowing the cleaning assembly 30 to move up or down relative to the housing 21 of the cleaning apparatus 1.

According further embodiments, the lifting mechanism 17 may slide with respect to the guiding base 11 when driven by the driving member 12, so that the cleaning assembly 30 may move up or down relative to the housing 21 of the cleaning apparatus 1. As such, the cleaning assembly 30 may move up from ground surface, so as to prevent a roller brush 33 of the cleaning assembly 30 from contacting a region of the ground surface where cleaning is not needed. In addition, the lifting device 10 for the cleaning assembly 30 also has the advantage of a simple structure.

The driving member 12 may be coupled to the lifting mechanism 17 by a transmission mechanism through which the driving member 12 drives the lifting mechanism 17 to slide with respect to the guiding base 11. For example, the transmission mechanism may be a threaded rod connecting the driving member 12 and the lifting mechanism 17. One end of the threaded rod may be fixedly coupled to and rotated by the driving member 12. The lifting mechanism 17 may be screwed onto the threaded rod through the other end of the threaded rod. Thus, when rotated, the threaded rod may cause the lifting mechanism 17 to slide with respect to the guiding base 11.

Alternatively, the driving member 12 may be directly coupled with the lifting mechanism 17 to drive the lifting mechanism 17 to slide with respect to the guiding base 11. For example, the driving member 12 may include a motor having an output shaft provided with a gear assembly. The lifting mechanism 17 is provided with a gear rack that is meshed with the gear assembly. Rotations of the output shaft of the motor may cause the gear assembly to drive the lifting mechanism 17 to slide with respect to the guiding base 11.

Still alternatively, the driving member 12 may cause the lifting mechanism 17 to move with respect to the guiding base 11 through a rope or cord connecting the lifting mechanism 17 and the driving member 12. Still alternatively, the lifting mechanism 17 may include a threaded hole along a vertical direction. Thus, the driving member 12 may be coupled with the lifting mechanism 17 through a threaded rod that matches the threaded hole, so as to drive the lifting mechanism 17 to slide with respect to the guiding base 11. Still alternatively, the output shaft of the driving member 12 may be connected to a cam that is engaged with the lifting mechanism 17. Thus, when rotated by the driving member 12, the cam may drive the lifting mechanism 17 to slide with respect to the guiding base 11.

According to some embodiments, the driving member 12 may also be provided with a magnetic element such as an electromagnet or the like. Thus, the driving member 12 may cause the lifting assembly 17 to move with respect to the guiding base 11 by way of magnetism.

Apart from the embodiments described above, the connection between the driving member 12 and the lifting mechanism 17 may also be realized through other structures as readily appreciated by one of ordinary skill in the art.

Figure 2:
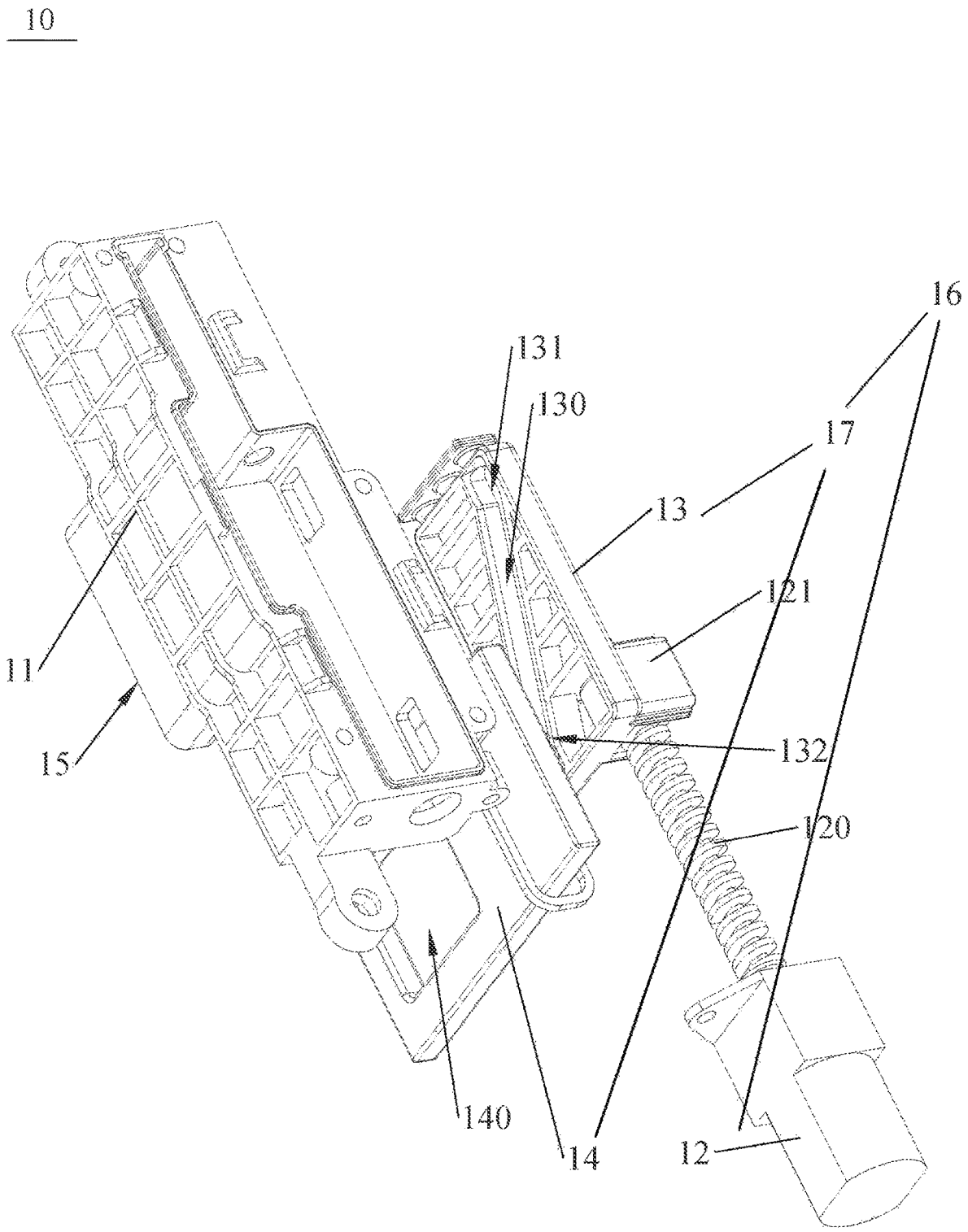
FIG. 2 illustrates an exploded view of the lifting device shown in FIG. 1, according to an exemplary embodiment of the present disclosure.
Figure 4:
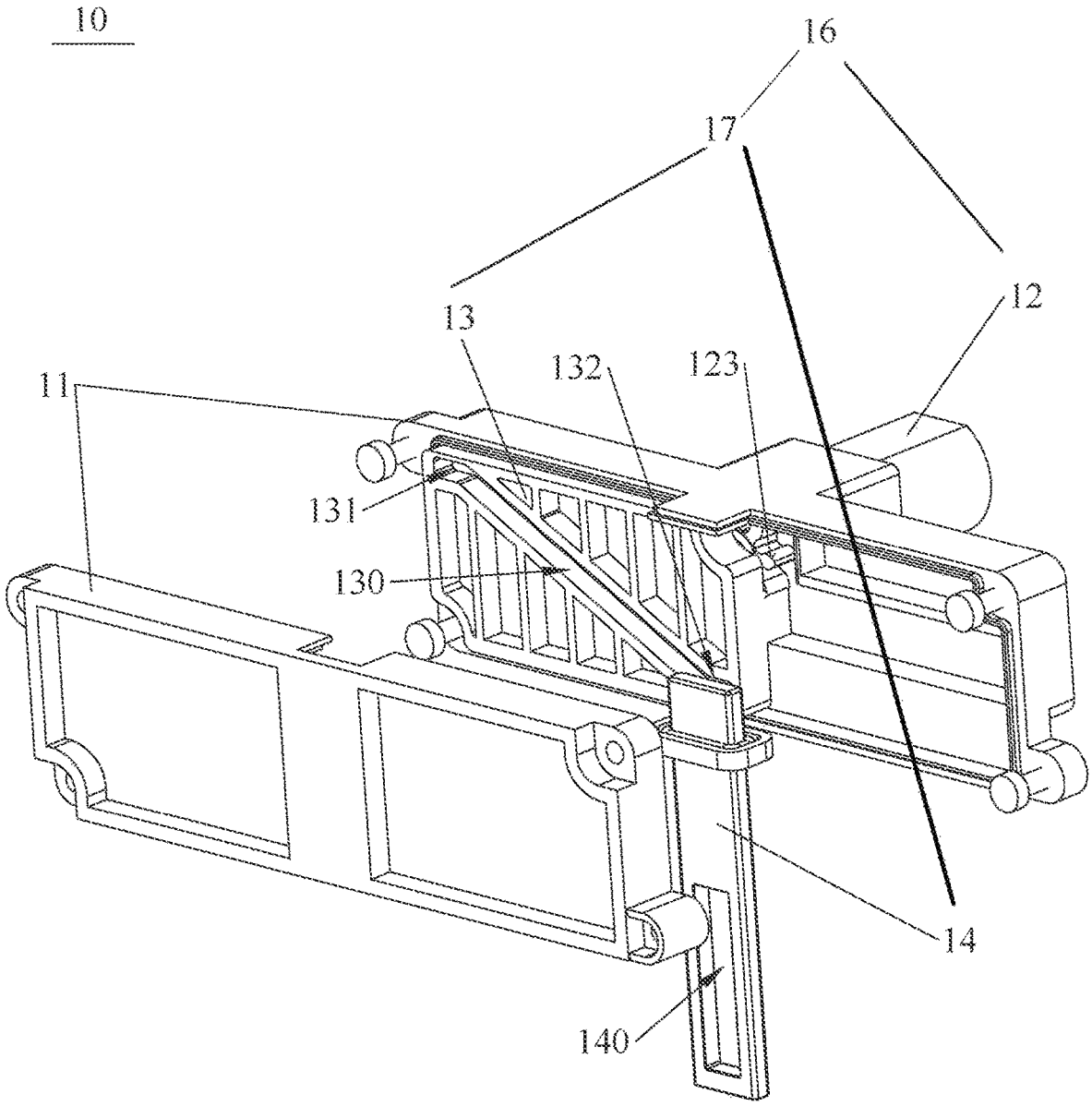
FIG. 4 illustrates an exploded view of the lifting device shown in FIG. 3, according to another exemplary embodiment of the present disclosure.

In some embodiments, as shown in FIG. 2 and FIG. 4, the lifting mechanism 17 includes a guiding block 13 and a lifting block 14. The guiding block 13 is slidably coupled to the guiding base 11. The driving member 12 is coupled with the guiding block 13. One of the lifting block 14 and the guiding block 13 is provided with a groove 130, and the other is slidably arranged in the groove 130. A side of the lifting block 14 away from the guiding block 13 is engaged with the cleaning assembly 30. The driving member 12 drives the guiding block 13 to slide with respect to the guiding base 11 in a first direction, thereby causing the lifting block 14 to move up or down along the groove 130 in a second direction. The first direction and the second direction are not parallel. The lifting block 14 may thus be moved up or down reliably by the cooperation among the guiding base 11, the guiding block 13, and the lifting block 14.

It should be understood that the groove 130 may be disposed on the guiding block 13 or the lifting block 14 in an inclined direction. When moving along the groove 130, the lifting block 14 produces a motion or a displacement in the second direction. The groove 130 may be a straight or a curved groove.

In some embodiments, the driving member 12 drives the guiding block 13 to move along the first direction, thereby changing the location of the groove 130. The groove 130 may then cause the lifting block 14 to slide therein, thereby producing a motion or displacement in the second direction.

It should be understood that, a ball bearing or the like may be provided in the groove 130 to make the lifting block 14 slide smoothly. Alternatively, lubricating oil may be applied to a groove wall of the groove 130, so as to reduce friction and to make the lifting block 14 slide smoothly.

In some embodiments, as shown in FIG. 1, the first direction is a horizontal direction, and the second direction is a vertical direction. The driving member 12 drives the guiding block 13 to slide along the horizontal direction, thereby changing the location of the groove 130. Accordingly, the lifting block 14 slides along the groove 130 and moves up or down in the vertical direction with respect to the guiding base 11. As a result of the vertical movement of the lifting block 14, the cleaning assembly 30 may be lifted up or dropped down.

In some embodiments, a sliding bracket (not shown) is provided on a side of the lifting block 14 facing the guiding block 13. The sliding bracket is slidably arranged in the groove 130. Through the relative sliding motion between the sliding bracket and the groove 130, the lifting block 14 is caused to move vertically with respect to the guiding base 11. As a result, the cleaning assembly 30 may be lifted up or dropped down as caused by the motion of the lifting block 14.

In some embodiments as shown in FIGS. 2 and 4, the groove 13 may include a plurality of sections including an inclined section, an upper transverse section 131 connected to a first end of the inclined section, and a lower transverse section 132 connected to a second end of the inclined section. The upper transverse section 131 and the lower transverse section 132 are parallel to the first direction (e.g., the horizontal direction). By such an arrangement, the lifting block 14 may stay at its highest position when sliding into the upper transverse section 131, and may stay at its lowest position when sliding into the lower transverse section 132. In other words, the upper transverse section 131 and the lower transverse section 132 defines the limits of movement of the lifting block 14 with respect to the guiding base 11. In addition, the upper transverse section 131 and the lower transverse section 132 may hold the lifting block 14 therein and prevent the lifting block 14 from moving back incidentally when it arrives at the highest and lowest position. Therefore, when lifting block 14 slides to its highest position, the cleaning assembly 30 may be lifted and held at the lifted position, so as to avoid contacting the ground or obstacles.

In some embodiments, the guiding block 13 of the lifting mechanism 17 may be omitted, and the lifting block 14 may be driven directly by the driving member 12.

In some embodiments, as shown in FIG. 2, the lifting device 10 further includes a transmission mechanism. The transmission mechanism includes a threaded rod 120. One end of the threaded rod 120 is connected to the driving member 12, and the other end of the threaded rod 120 is coupled to the guiding block 13. The guiding block 13 may include a threaded hole for receiving the threaded rod 120. The threaded rod 120 is positioned in parallel with the first direction (e.g., the horizontal direction). In this embodiment, the driving member 12 drives the threaded rod 120 to rotate so that the guiding block 13 may move in the first direction with the rotation of the threaded rod 120. Thereby, the lifting block 14 is moved up or down along the second direction (e.g., the vertical direction).

In some embodiments, the transmission mechanism further includes a fixing member 121. The fixing member 121 fixedly connects with the guiding block 13 and includes a threaded hole for receiving an end of the threaded rod 120.

Figure 5:
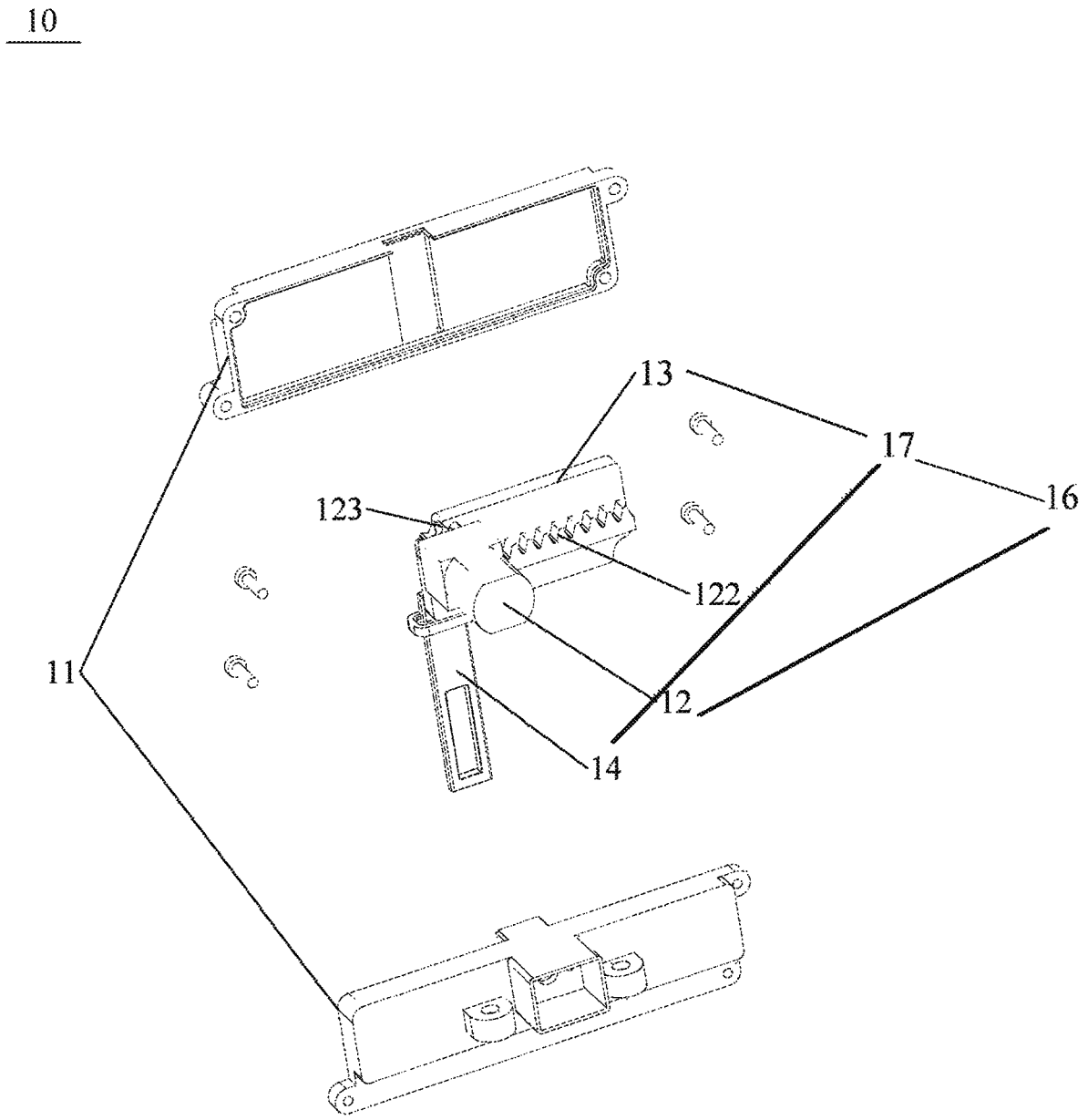
FIG. 5 illustrates another exploded view of the lifting device shown in FIG. 3, according to another exemplary embodiment of the present disclosure.

Of course, the transmission mechanism of the present disclosure is not limited to the threaded rod 120. For example, in some other embodiments, as shown in FIGS. 4 and 5, the transmission mechanism may include a rack 122 and a gear 123. The rack 122 is arranged on the guiding base 11 and is parallel to the first direction (e.g., the horizontal direction). The gear 123 meshes with the rack 122. The driving member 12 is connected to the gear 123 and drives the gear 123 to rotate. The rack 122 may move in the first direction, as caused by the rotation of the gear 123. As a result, the guiding block 13 may move in the first direction, thereby causing the lifting block 14 to move up or down in the second direction.

In some embodiments, the rack 122 and the guiding base 11 are integrally formed, which may further simplify the structure of the lifting device 10.

Figure 3:
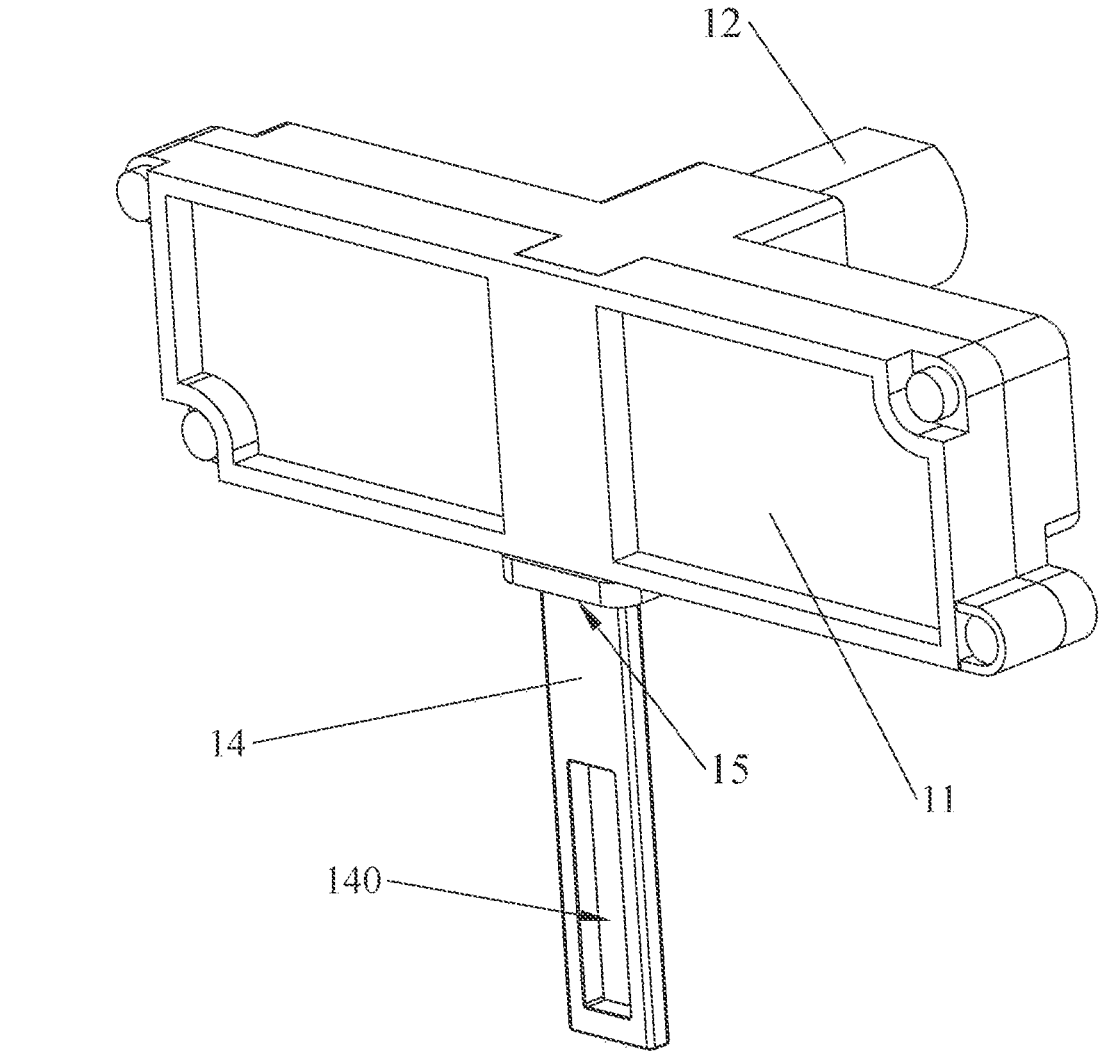
FIG. 3 illustrates a view of a lifting device for cleaning assembly, according to another exemplary embodiment of the present disclosure.

In some embodiments, as shown in FIGS. 1-3, the guiding base 11 may include a guiding hole 15. The lifting block 14 is slidably arranged in the guiding hole 15 along the section direction. The guiding block 13 is disposed above the guiding hole 15. In this embodiment, the guiding hole 15 is a through hole along the second direction, and is configured to limit the position of the lifting block 14. Thus, the lifting block 14 may be ensured to move up or down along the second direction as caused by the movement of the guiding block 13.

In some embodiments, the cleaning assembly 30 includes a lap portion 31. The lifting block 14 may include an opening or a hole 140. The lap portion 31 of the cleaning assembly 30 may be disposed in the hole 140. A dimension of the hole 140 in the second direction is greater than the dimension of the lap portion 31. As a result, the lap portion 31 is allowed to move up or down within the hole 140. Thus, during cleaning of a surface, when the cleaning assembly 30 is pushed up by an obstacle, the lap portion 31 may move upward while remaining in the hole 140. After the cleaning assembly 30 moves over the obstacle, the cleaning assembly 30 may drop down under its own gravity. As a result, the lap portion 31 may fall down and be seated upon an inner edge of the hole 140. With such a cooperation of the hole 140 and the lap portion 31, the cleaning assembly 30 may realize a self-adaptive floating, which is beneficial for the cleaning assembly 30 when moving over obstacles or uneven ground smoothly.

According to a further embodiment, when the lifting block 14 moves upwards caused by the driving member 12, the lap portion 31 located in the hole 140 may be lifted upward accordingly by the lifting block 14 through the engagement between the lap portion 31 and the inner edge of the hole 140. Thereby, the cleaning assembly 30 may move upward accordingly. When the lifting block 14 moves downwards caused by the driving member 12, the lap portion 31 may lose the support from the lifting block 14 and fall down accordingly. Thus, the cleaning assembly 30 may move down accordingly.

As described above, the lifting device 10 not only allows the cleaning assembly 30 to be lifted up by way of the driving member 12 and the lifting mechanism 17 so as to leave the ground surface when the cleaning assembly 30 is not in use, but also allows self-adaptive floating of the cleaning assembly 30 by way of the engagement between the lap portion 31 and the hole 140. As a result, the cleaning assembly 30 may adapt to the ground conditions in the vertical direction, and the adaptability of the cleaning assembly may be improved.

Figure 6:
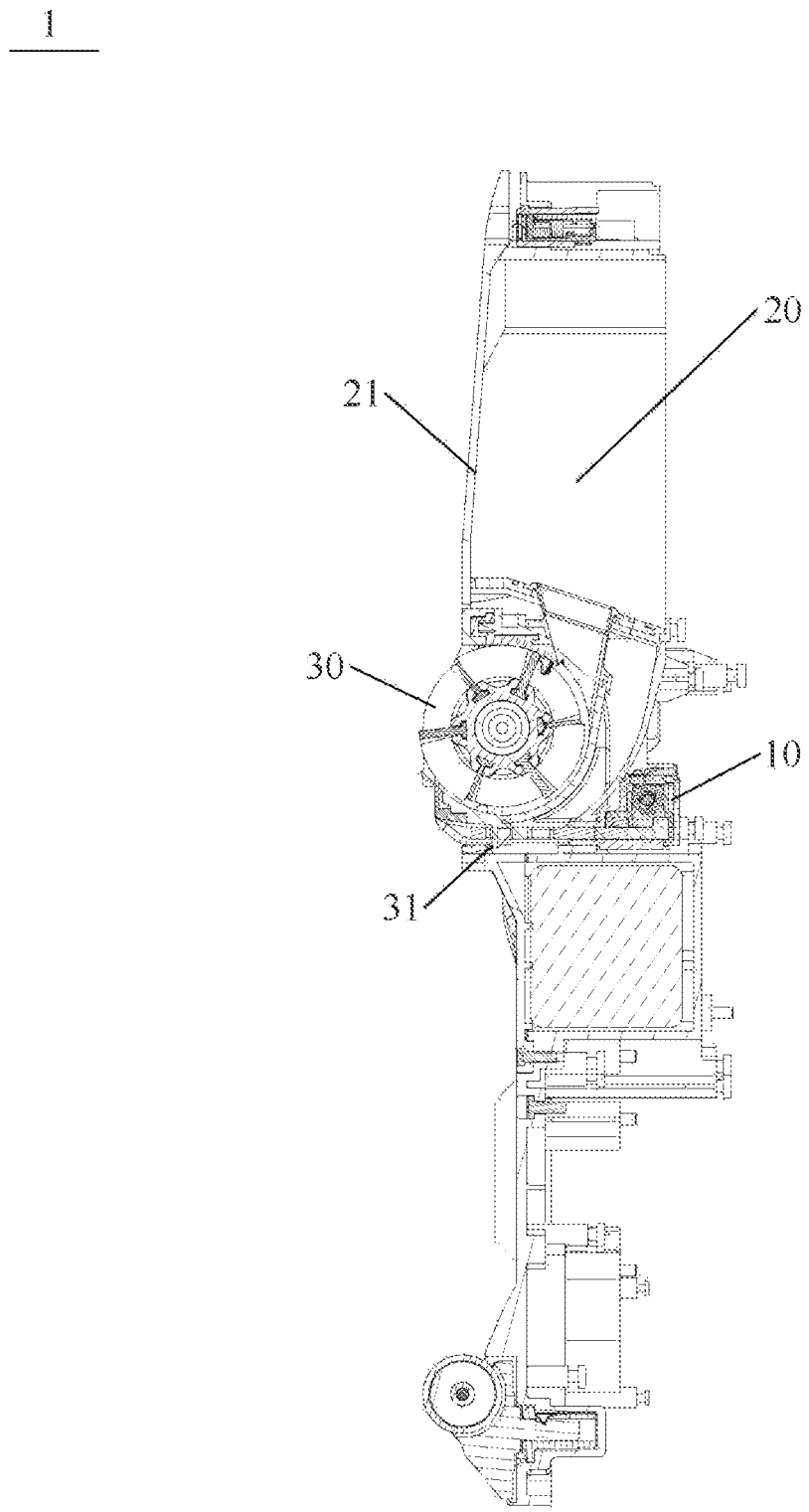
FIG. 6 illustrates a cross-sectional view of a cleaning apparatus according to an exemplary embodiment of the present disclosure.
Figure 7:
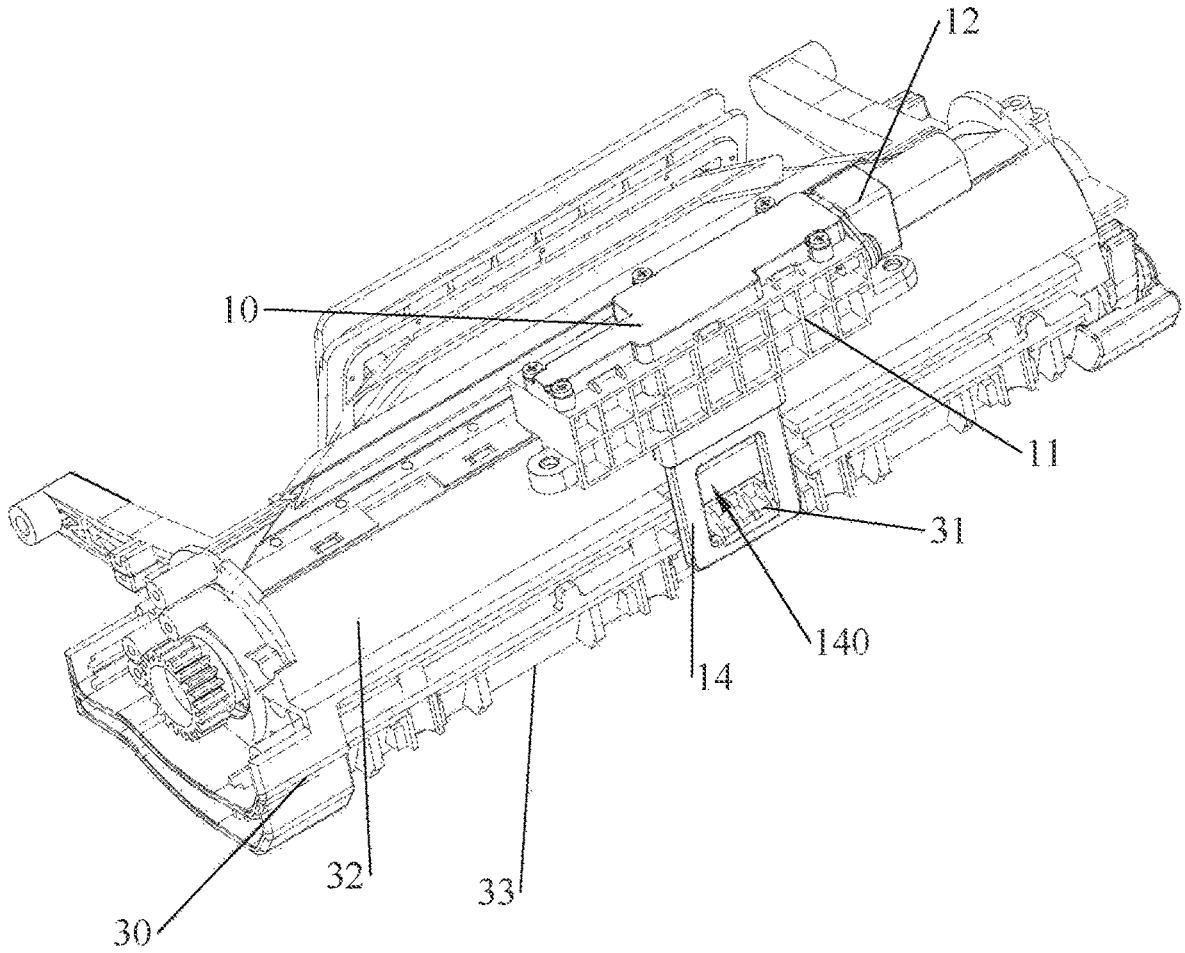
FIG. 7 illustrates a view of a lifting device and a cleaning assembly of the cleaning apparatus shown in FIG. 6, according to an embodiment of the present disclosure.

Referring to FIGS. 6 and 7, the present disclosure further provides a cleaning apparatus 1 which includes the main body 20, the lifting device 10, and the cleaning assembly 30. The main body 20 includes the housing 21, and the guiding base 11 is arranged on the housing 21.

The lifting mechanism 17 of the lifting device 10 may be coupled to slide with respect to the guiding base 11 by way of the driving member 12. The cleaning assembly 30 is engaged with the lifting block 14 of the lifting mechanism 17 through the lap portion 31. When the lifting block 14 moves up or down relative to the guiding base 11, the cleaning assembly 30 may be lifted up or dropped down relative to the housing 21. As a result, the cleaning assembly 30 may be lifted from the ground to prevent contacting with a surface region where cleaning is not needed. Also, the lifting device 10 of the cleaning apparatus 1 of the present disclosure has the advantage of a simple structure.

As shown in FIG. 7, the cleaning assembly 30 includes a roller brush housing 32, a roller brush 33, and a roller brush driving mechanism (not shown). The roller brush 33 is arranged in the roller brush housing 32, and the roller brush driving mechanism is also arranged in the roller brush housing 32 to drive the roller brush 33 to rotate. The roller brush housing 32 is engaged with the lifting block 14 of the lifting mechanism 17 through the lap portion 31. Thus, the roller brush housing 32 may be lifted up or dropped down when the driving member 12 drives the lifting block 14 to move up or down. Thereby, the cleaning assembly 30 can be lifted up or dropped down. When the cleaning assembly 30 moves over an obstacle on the ground, the cleaning assembly 30 may be pushed upward by the obstacle without affecting the movement of the cleaning apparatus 1 on the ground.

In some embodiments, the roller brush housing 32 includes the lap portion 31. The lifting mechanism includes the lifting block 14, which may be lifted up or dropped down relative to the guiding base 11. The lifting block 14 is configured with a hole 140, and the lap portion 31 extends the hole 140. The hole 140 has a dimension greater than the dimension of the lap portion 31 along the vertical direction. When the cleaning assembly 30 is pushed by an obstacle, the lap portion 31 may be allowed to move upward within the floating hole 140, so that the cleaning assembly 30 may move over the obstacle. After moving over the obstacle, the cleaning assembly 30 may fall downward under its own gravity, causing the lap portion 31 to move downward within the floating hole 140. With such a cooperation of the floating hole 140 and the lap portion 31, the cleaning assembly 30 may realize a self-adaptive floating, which allows the cleaning apparatus 1 to pass over obstacles and travel on an uneven ground smoothly.

When the driving member 12 causes the lifting block 14 to move upward, the lap portion 31, engaged with an inner edge of the floating hole 140, is lifted up by the lifting block 14. Accordingly, the cleaning assembly 30 is caused to move upward. When the driving member 12 causes the lifting block 14 to move downward, the lap portion 31 may lose the support coming from the lifting block 14 and fall downward, causing the cleaning assembly 30 to move downward.

As described above, the driving member 12 and the lifting mechanism 17 described herein may cause the cleaning assembly 30 to be lifted from the ground when a cleaning is not needed. In addition, the lifting mechanism 17 may allow self-adaptive floating of the cleaning assembly 30, through the cooperation of the lap portion 31 and the floating hole 140, according to ground conditions. Therefore, the adaptability of the cleaning assembly 30 is improved.

While the disclosure has been described in connection with what are presently considered to be the most practical and preferred embodiments, it is to be understood that the disclosure is not to be limited to the disclosed embodiments, but on the contrary, is intended to cover various modifications and equivalent arrangement included within the spirit and scope of the disclosure.

The invention claimed is:

1. A lifting device for a cleaning assembly comprising:
a guiding base arranged on an external housing; and
a lifting assembly comprising:
a lifting mechanism slidably coupled to the guiding base; and
a driving member arranged on the guiding base and configured to drive the lifting mechanism to move with respect to the guiding base,
wherein the lifting mechanism is connectable with the cleaning assembly to allow the cleaning assembly to be lifted relative to the housing along with the lifting mechanism when the lifting mechanism is driven by the driving member to be lifted with respect to the guiding base, or to be lowered relative to the housing along with the lifting mechanism when the lifting mechanism is driven by the driving member to be lowered with respect to the guiding base.

2. The lifting device as claimed in claim 1, wherein the lifting mechanism comprises:
a guiding block slidably connected to the guiding base and engaged with the driving member through a driving mechanism; and
a lifting block coupled with the cleaning assembly;
wherein the lifting block and the guiding block are slidably engaged with each other through a groove disposed on one of the lifting block and the guiding block,
wherein the driving member drives the guiding block to move in a first direction, and
wherein in response to the movement of the guiding block in the first direction, the lifting block moves in a second direction, and
wherein the first direction and the second direction are not parallel.

3. The lifting device as claimed in claim 2, wherein the groove is disposed on the guiding block and configured to engage with the lifting block.

4. The lifting device as claimed in claim 3, wherein a sliding bracket is provided on a side of the lifting block facing the guiding block, and the sliding bracket is slidably arranged in the groove.

5. The lifting device as claimed in claim 3, wherein the groove includes an inclined section, an upper transverse section connected to a first end of the inclined section, and a lower transverse section connected to a second end of the inclined section, and wherein the upper transverse section and the lower transverse section are parallel to the first direction.

6. The lifting device as claimed in claim 3, further comprising a transmission mechanism having a threaded rod having a first end coupled to the driving member and a second end coupled to the guiding block, wherein the threaded rod is parallel to the first direction.

7. The lifting device as claimed in claim 6, wherein the transmission mechanism further comprises a fixing member fixedly connected with the guiding block and threadedly connected with the second end of the threaded rod.

8. The lifting device as claimed in claim 3, further comprising:
a transmission mechanism having a rack arranged on the guiding base and in parallel with the first direction; and a gear meshed with the rack, wherein the driving member is connected to the gear and configured to drive the gear to rotate.

9. The lifting device as claimed in claim 8, wherein the rack and the guiding base are integrally formed.

10. The lifting device as claimed in claim 2, wherein the guiding base includes a guiding hole, the lifting block is slidably arranged through the guiding hole, and the guiding block is disposed above the guiding hole.

11. The lifting device as claimed in claim 2, wherein the lifting block has a hole configured to receive a lap portion of the cleaning assembly and allow the lap portion to move in the second direction within the hole when the cleaning assembly is pushed by an object.

12. A cleaning apparatus, comprising:

a main body comprising a housing;

a cleaning assembly disposed in the main body and configured to clean a surface;

a lifting device comprising:

a guiding base arranged on the housing; and a lifting assembly comprising a lifting mechanism slidably coupled to the guiding base, and a driving member arranged on the guiding base and configured to drive the lifting mechanism to move with respect to the guiding base, wherein the lifting mechanism is connectable with the cleaning assembly to allow the cleaning assembly to be lifted relative to the housing along with the lifting mechanism when the lifting mechanism is driven by the driving member to be lifted with respect to the guiding base, or to be lowered relative to the housing along with the lifting mechanism when the lifting mechanism is driven by the driving member to be lowered with respect to the guiding base.

13. The cleaning apparatus as claimed in claim 12, wherein the cleaning assembly comprises:

a roller brush housing movably connected with the lifting mechanism;

a roller brush arranged on the roller brush housing; and a roller brush driving mechanism arranged on the roller brush housing to drive the roller brush to rotate.

14. The cleaning apparatus as claimed in claim 13, wherein:

the roller brush housing comprises a lap portion;

the lifting mechanism comprises a lifting block configured to move relative to the guiding base, the lifting block including a hole configured to receive the lap portion of the roller brush housing; and the lap portion moves within the hole when the cleaning assembly is pushed by an object on the surface.

15. The cleaning apparatus as claimed in claim 12, wherein the lifting mechanism comprises:

a guiding block slidably connected to the guiding base and engaged with the driving member through a driving mechanism; and a lifting block coupled with the cleaning assembly;

wherein the lifting block and the guiding block are slidably engaged with each other through a groove disposed on one of the lifting block and the guiding block, wherein the driving member drives the guiding block to move in a first direction, and wherein in response to the movement of the guiding block in the first direction, the lifting block moves in a second direction, and wherein the first direction and the second direction are not parallel.

16. The cleaning apparatus as claimed in claim 15, wherein the groove is disposed on the guiding base and configured to engage with the lifting block.

17. The cleaning apparatus as claimed in claim 16, wherein a sliding bracket is provided on a side of the lifting block facing the guiding block, and the sliding bracket is slidably arranged in the groove.

18. The cleaning apparatus as claimed in claim 16, wherein the groove includes an inclined section, an upper transverse section connected to a first end of the inclined section, and a lower transverse section connected to a second end of the inclined section, and wherein the upper transverse section and the lower transverse section are parallel to the first direction.

19. The cleaning apparatus as claimed in claim 16, further comprising a transmission mechanism having a threaded rod having a first end coupled to the driving member and a second end coupled to the guiding block, wherein the threaded rod is parallel to the first direction.

20. The cleaning apparatus as claimed in claim 19, wherein the transmission mechanism further comprises a fixing member fixedly connected with the guiding block and threadedly connected with the second end of the threaded rod.

* * * * *